US009304440B2

(12) United States Patent
Yoshida et al.

(10) Patent No.: US 9,304,440 B2
(45) Date of Patent: Apr. 5, 2016

(54) DEVELOPER ACCOMMODATING UNIT, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Masatomi Yoshida, Kawasaki (JP); Masaki Furutani, Tokyo (JP); Kojiro Yasui, Numazu (JP); Tetsuo Uesugi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/018,467

(22) Filed: Sep. 5, 2013

(65) Prior Publication Data

US 2014/0072330 A1 Mar. 13, 2014

(30) Foreign Application Priority Data

Sep. 11, 2012 (JP) ..... 2012-199741

(51) Int. Cl.
*G03G 15/08* (2006.01)
*G03G 21/16* (2006.01)

(52) U.S. Cl.
CPC ..... *G03G 15/0881* (2013.01); *G03G 15/0841* (2013.01); *G03G 15/0874* (2013.01); *G03G 15/0884* (2013.01); *G03G 21/1676* (2013.01); *G03G 2215/0682* (2013.01); *G03G 2215/0687* (2013.01); *G03G 2215/0875* (2013.01)

(58) Field of Classification Search
CPC ..... G03G 15/0841; G03G 15/0874; G03G 21/1676; G03G 2215/0682; G03G 2215/0687; G03G 2215/0875; G03G 15/0884; G03G 15/0881
USPC ..... 399/103, 106, 119, 120, 258
See application file for complete search history.

(56) References Cited

U.S. PATENT DOCUMENTS 6,058,278 A * 5/2000 Tsuda et al. ..... 399/106
6,128,462 A 10/2000 Kato et al.
6,169,869 B1 1/2001 Inami et al.

(Continued)

FOREIGN PATENT DOCUMENTS

JP 4-66980 A 3/1992

OTHER PUBLICATIONS

Office Action in Chinese Patent Application No. 201310402959.3, dated Nov. 3, 2015 (with English Translation).

*Primary Examiner* — Ryan Walsh
(74) *Attorney, Agent, or Firm* — Fitzpatrick, Cella, Harper & Scinto

(57) ABSTRACT

A developer accommodating unit includes: a flexible container including an opening for permitting discharge of a developer; a sealing member for forming a bonding portion between itself and the flexible container; an unsealing member; and an accommodating container. The bonding portion includes a first bonding portion extending in a longitudinal direction of the sealing member at a periphery of the opening in an upstream side of a peeling direction of the sealing member, a second bonding portion extending in the longitudinal direction at the periphery of the opening in a downstream side of the peeling direction, and a third bonding portion bonded upstream of the first bonding portion with respect to the peeling direction. When the sealing member exposes the opening, the bonding portion is peeled in the order of the third bonding portion, the first bonding portion and the second bonding portion.

20 Claims, 16 Drawing Sheets

(56) References Cited

U.S. PATENT DOCUMENTS

| | | | | |
|---|---|---|---|---|
| 6,175,703 | B1 | 1/2001 | Nakazono et al. | |
| 6,539,190 | B2 | 3/2003 | Oba et al. | |
| 6,681,088 | B2 | 1/2004 | Kanno et al. | |
| 6,760,556 | B2 * | 7/2004 | De Kesel et al. | 399/106 |
| 6,859,629 | B2 | 2/2005 | Miura et al. | |
| 6,898,401 | B2 | 5/2005 | Okano et al. | |
| 6,963,706 | B2 | 11/2005 | Morioka et al. | |
| 6,978,100 | B2 | 12/2005 | Yasui et al. | |
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,155,137 | B2 | 12/2006 | Yasui et al. | |
| 7,398,040 | B2 | 7/2008 | Yoshida | |
| 2013/0164039 | A1 | 6/2013 | Matsushita et al. | |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |

* cited by examiner (a)

(b)

(a)

(b)

DEVELOPER ACCOMMODATING UNIT, PROCESS CARTRIDGE AND ELECTROPHOTOGRAPHIC IMAGE FORMING APPARATUS

FIELD OF THE INVENTION AND RELATED ART

The present invention relates to a developer accommodating unit for accommodating a developer, a process cartridge including the developing accommodating unit and an electrophotographic image forming apparatus including the process cartridge.

The image forming apparatus forms an image on a recording material (medium) by using, e.g., an electrophotographic image forming process and may include, e.g., an electrophotographic copying machine, an electrophotographic printer (such as an LED printer or a laser beam printer), an electrophotographic facsimile machine, and the like. Further, the process cartridge refers to a cartridge, prepared by integrally assembling at least a developing device accommodating a developing means and a developer, detachably mountable to a main assembly of the image forming apparatus, or refers to a cartridge, prepared by integrally assembling the developing device and a photosensitive member unit at least including a photosensitive member, detachably mount able to the main assembly of the image forming apparatus.

In a conventional electrophotographic image forming apparatus, a process cartridge type in which a photosensitive drum and process means actable on the photosensitive drum are integrally assembled into a cartridge and this cartridge is detachably mountable to the main assembly of the image forming apparatus is employed. As an invention employing such a process cartridge type, an invention described in Japanese Laid-Open Patent Application (JP-A) Hei 4-66980 is disclosed. In JP-A Hei 4-66980, a toner bag (flexible container is accommodated inside a housing. An opening of this toner bag is closed by an opening tape (sealing member). When the opening rape is pulled, the opening is opened, so that a toner (developer) is discharged from the toner bag and is supplied to a developing sleeve.

However, the invention disclosed in JP A Hei 4 66980 involves the following problem. Although the opening of the flexible container is sealed by the sealing member in a state in which the developer is accommodated in the flexible container, an unexpected force acts on a bonding portion, during transportation or the like, where the sealing member is bonded to a portion in the neighborhood of the opening, so that there is a possibility that a part of the bonding portion is peeled. By this peeling, a performance of sealing the developer by the bonding portion is lowered. Further, in a process until the process cartridge is delivered to a user and then the user mounts the process cartridge in the main assembly of the image forming apparatus, there is a possibility that the peeling of the bonding portion advances and thus the developer leaks out from the flexible container to contaminate a hand of the user.

SUMMARY OF THE INVENTION

A principal object of the present invention is to provide a developing accommodating unit capable of reducing, in a constitution in which an opening of a flexible container in which a developer is accommodated is sealed by a sealing member, a phenomenon such that an unexpected force acts on a bonding portion for bonding the sealing member at a periphery of the opening.

According to an aspect of the present invention, there is provided a developer accommodating unit comprising: a flexible container including an opening for permitting discharge of a developer; a sealing member for forming a bonding portion between itself and the flexible container to seal the opening; an unsealing member, mounted on the sealing member, for unsealing the sealing member; and an accommodating container for accommodating therein the flexible container, the sealing member and the unsealing member, wherein the bonding portion includes a first bonding portion extending in a longitudinal direction of the sealing member as a periphery of the opening in an upstream side of a peeling direction of the sealing member, a second banding portion extending in the longitudinal direction at the periphery of the opening in a downstream side of the peeling direction, and a third bonding portion bonded upstream of the first bonding portion with respect to the peeling direction, and whereby when the sealing member exposes the opening, the bonding portion is peeled in the order of the third bonding portion, the first bonding portion and the second bonding portion.

These and other objects, features and advantages of the present invention will become more apparent upon a consideration of the following description of the preferred embodiments of the present invention taken in conjunction with the accompanying drawings.

Figure 9:
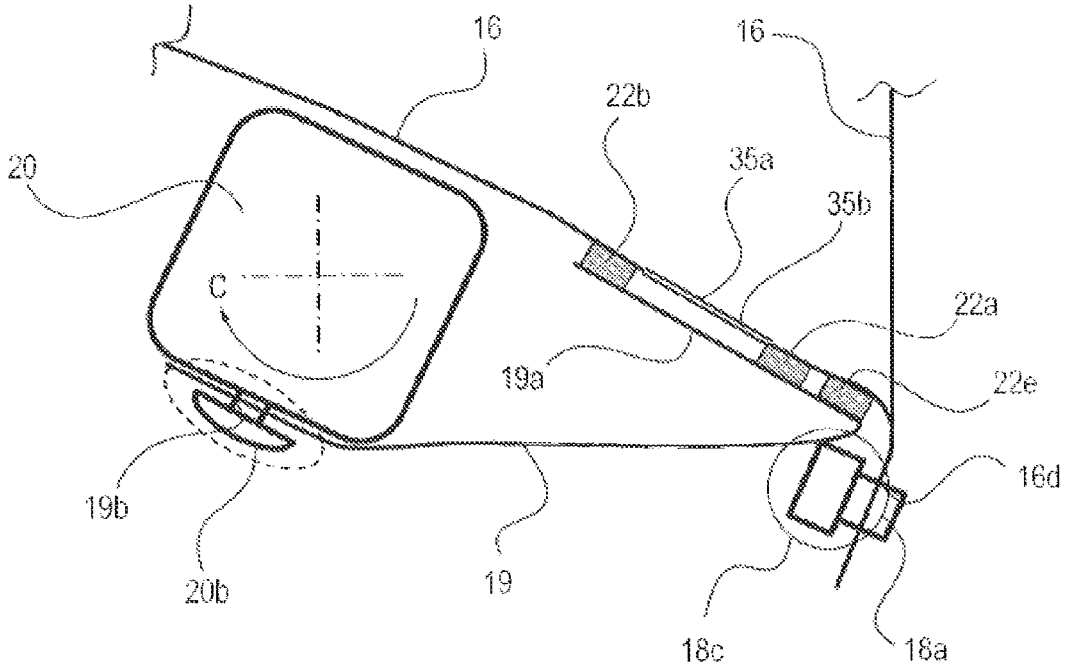
Figure 9:
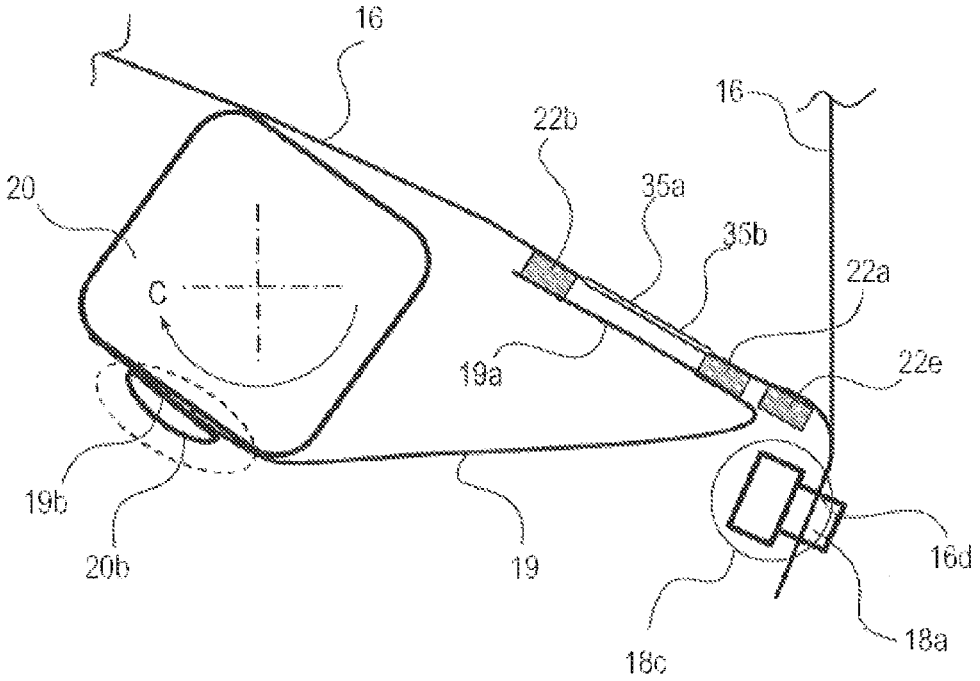
Figure 10:
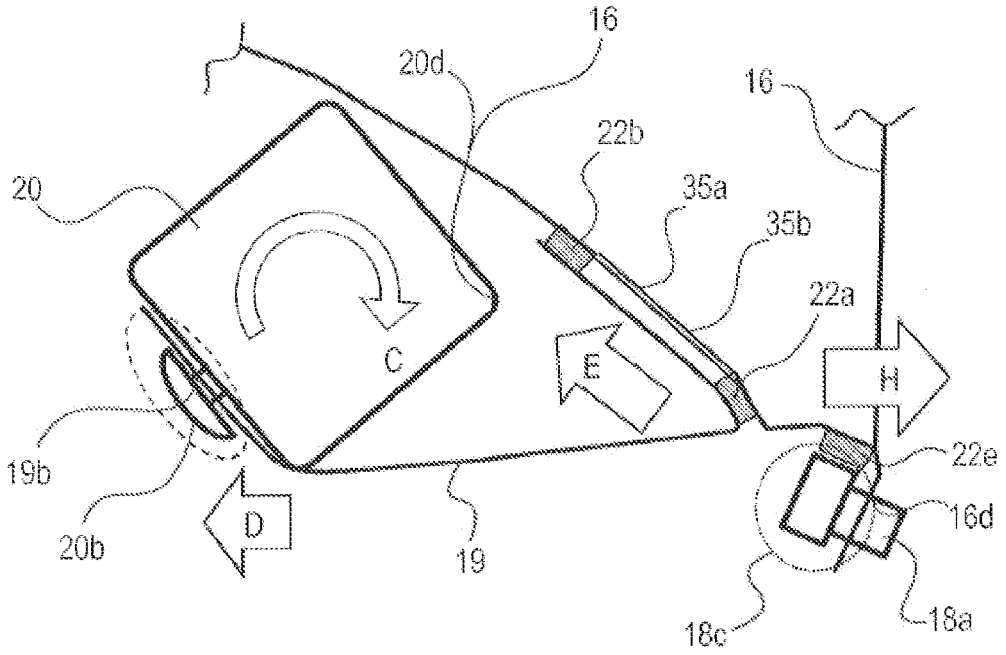
Figure 10:
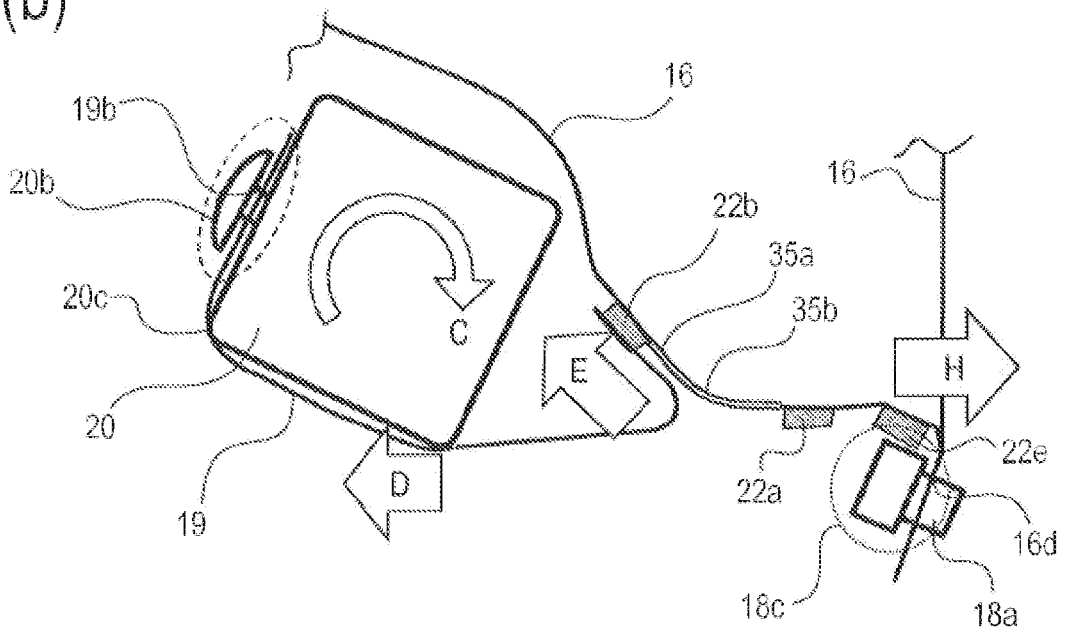
Figure 11:
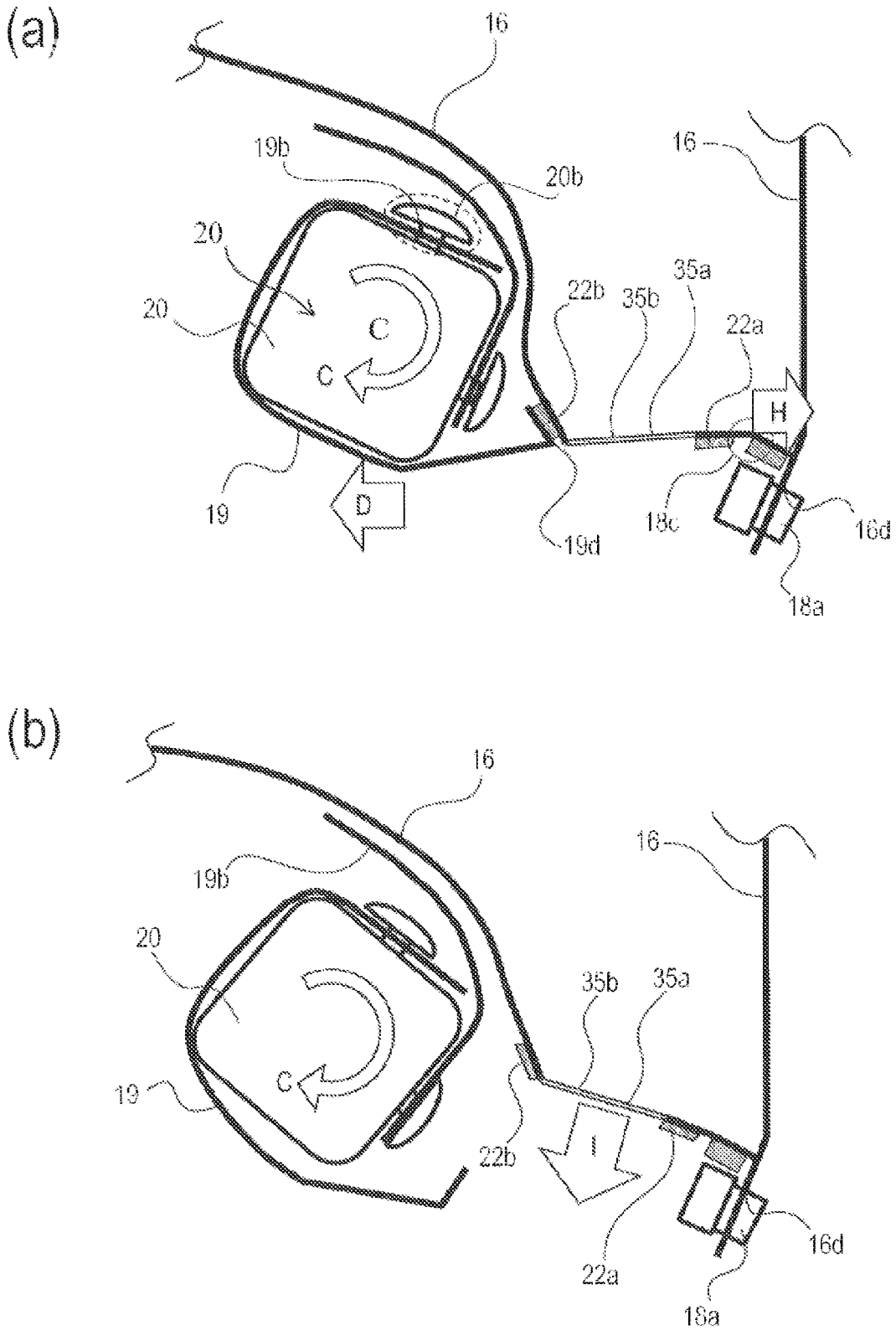

Parts (a) and (b) of FIG. 9, parts (a) and (b) of FIG. 10 and parts (a) and (b) of FIG. 11 are partly enlarged sectional views each showing a developer bag.

Figure 12:
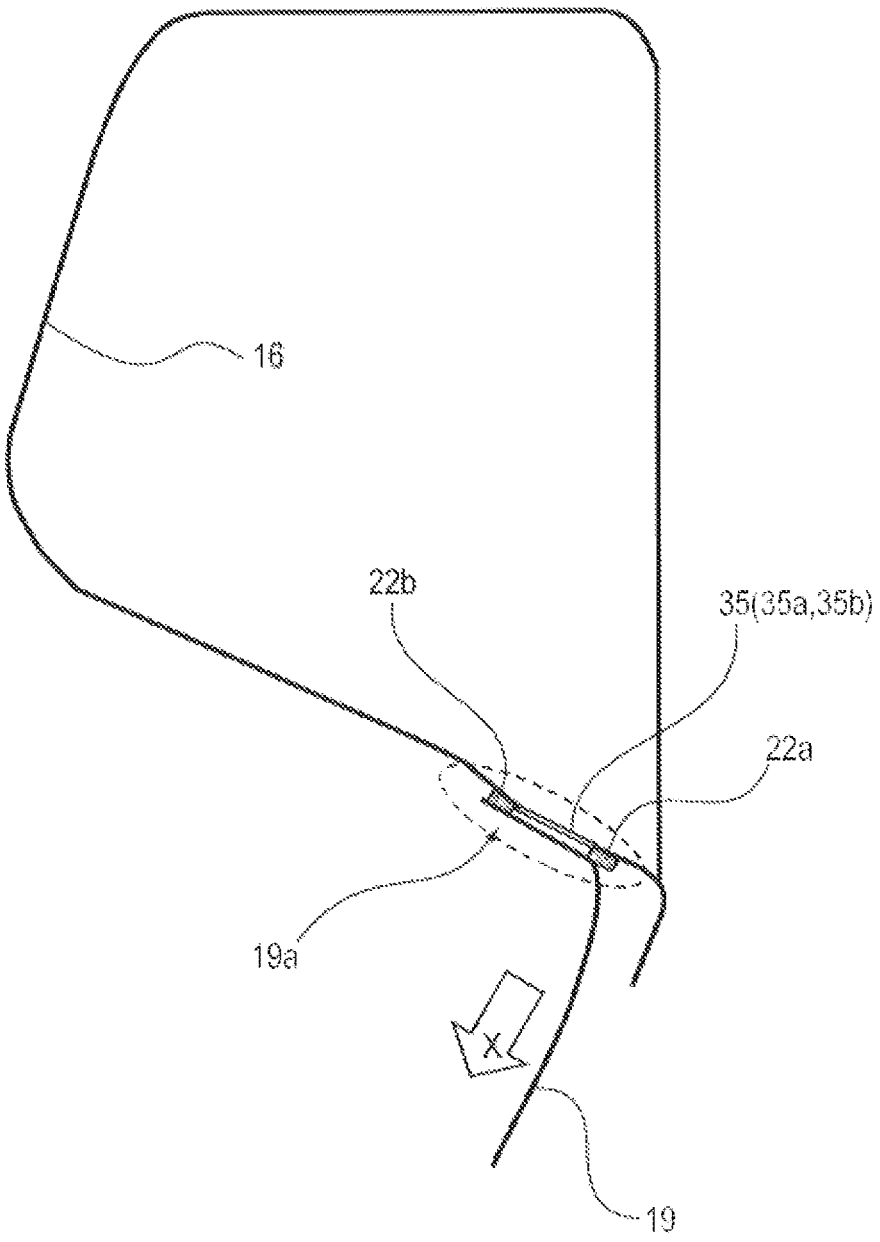

FIG. 12 is a sectional view showing a developer bag in a comparison example.

Figure 13:
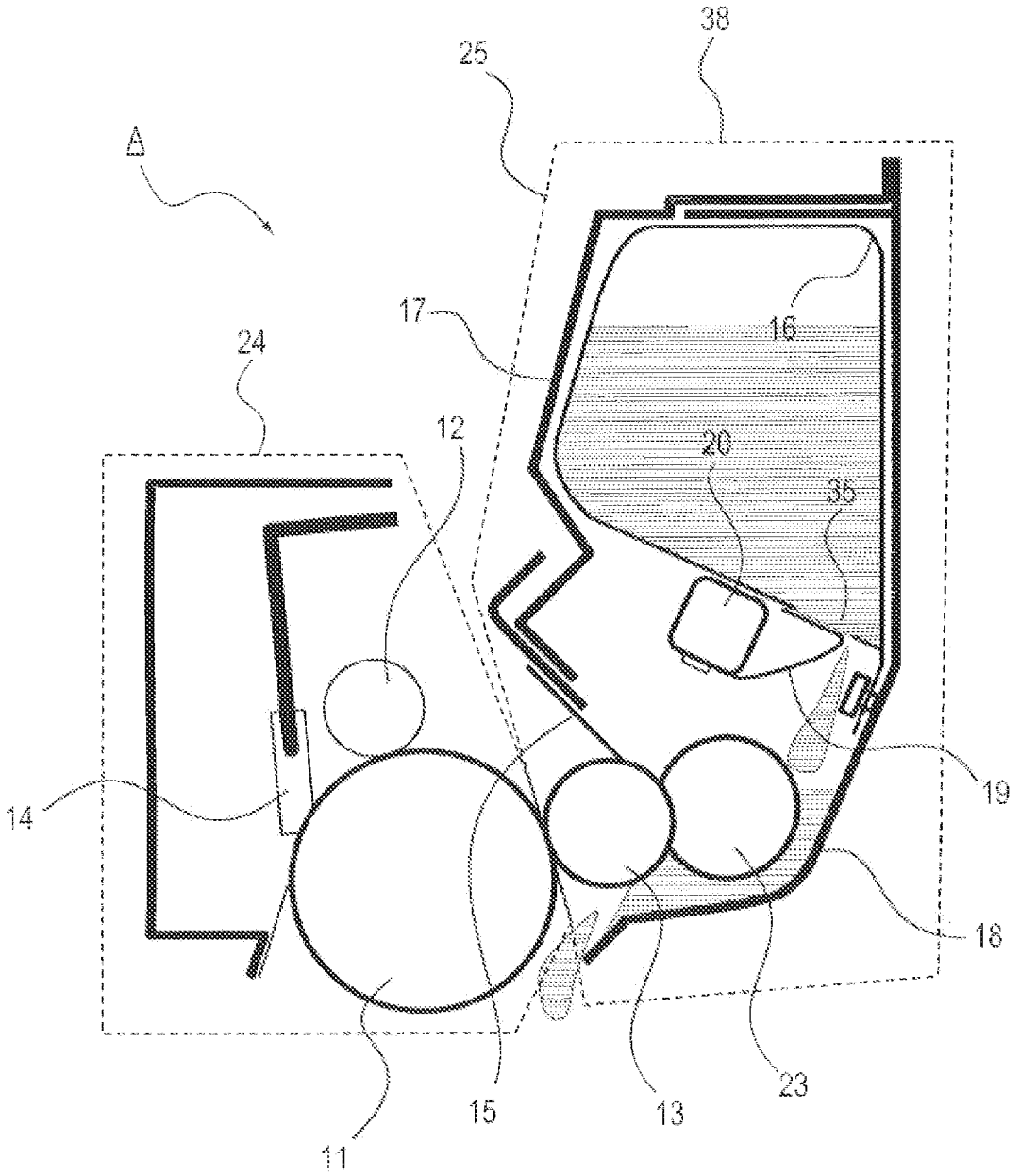

FIG. 13 is a sectional view showing a cartridge in the comparison example.

Figure 14:
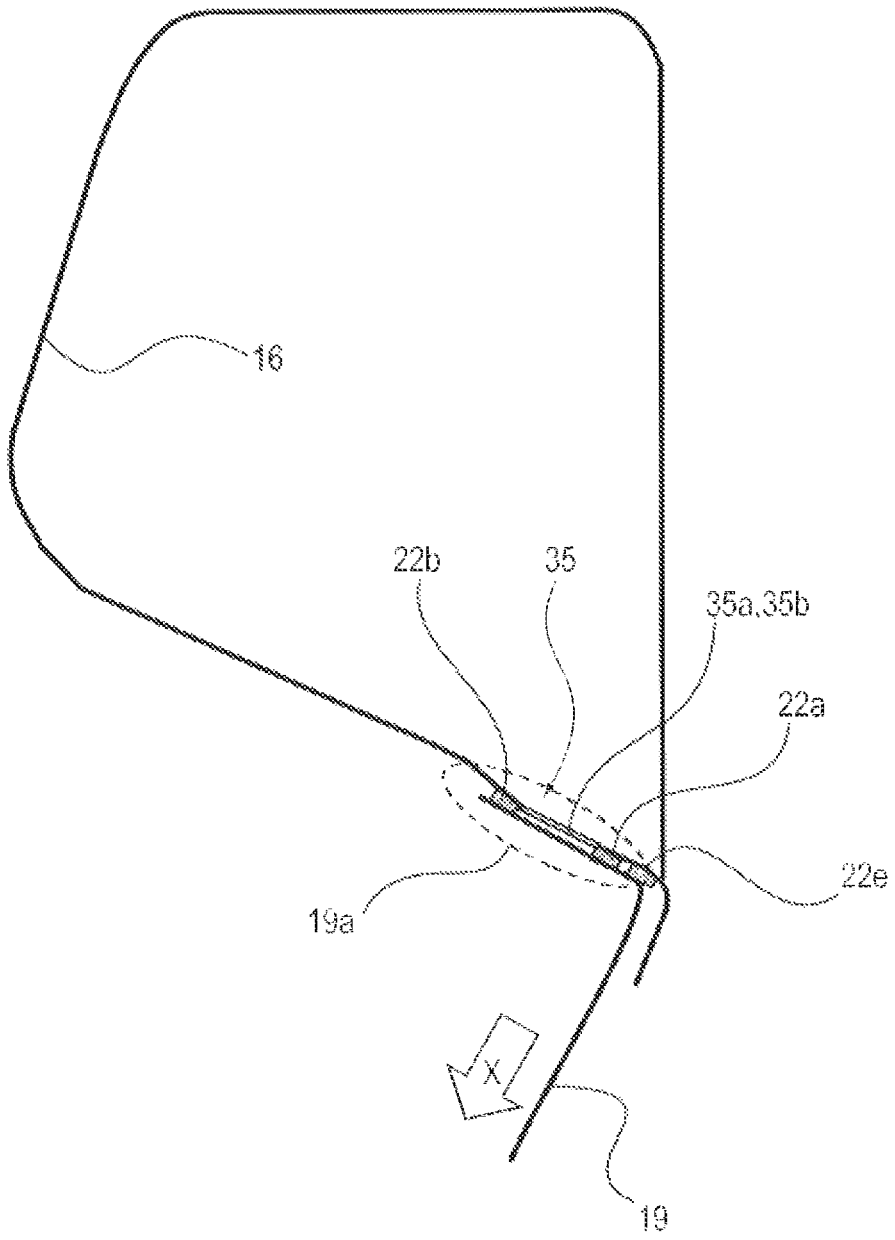

FIG. 14 is a sectional view showing the developer bag.

Figure 15:
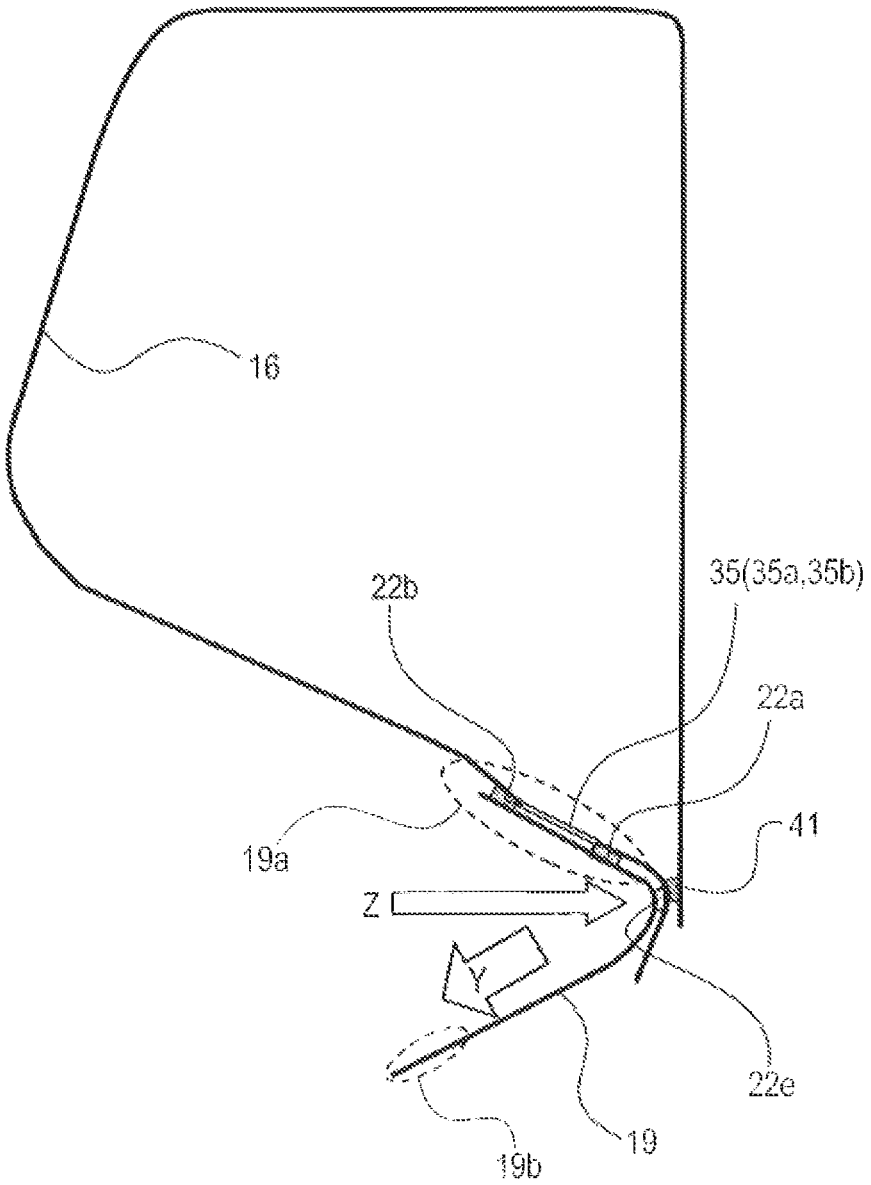

FIG. 15 is a sectional view of a developer bag in Embodiment 2.

Figure 16:
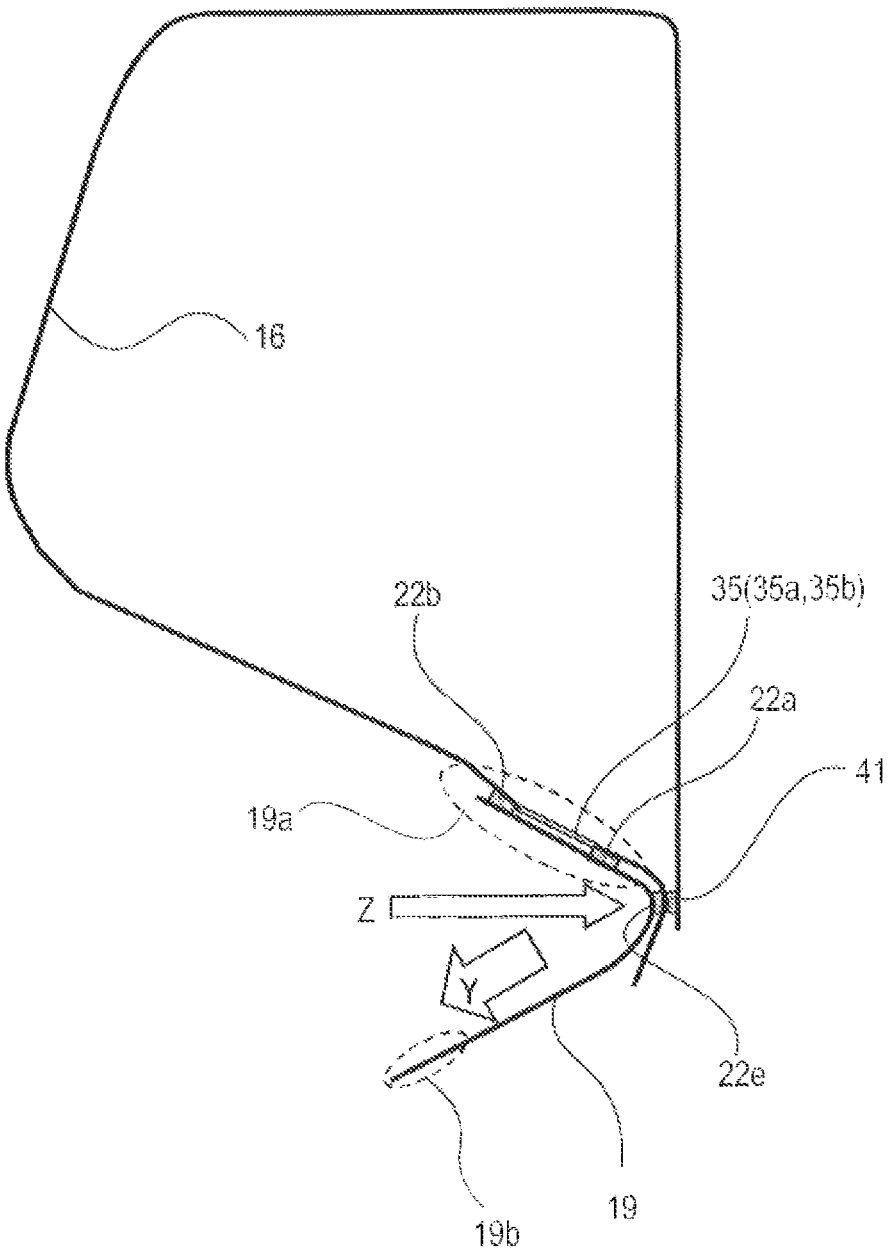

FIG. 16 is a sectional view of a modified example of the developer bag in Embodiment 2.

DESCRIPTION OF THE PREFERRED EMBODIMENTS

Hereinbelow, embodiments for carrying out the present invention will be exemplarily and specifically described on the basis of Embodiments with reference to the drawings. However, dimensions, materials, shapes, relative arrangements, and the like of constituent elements described in the following embodiments are appropriately changed depending on constitutions or various conditions of devices (apparatuses) to which the present invention is applied, and therefore the scope of the present invention is not limited thereto unless otherwise specified.

Embodiment 1

Figure 1:
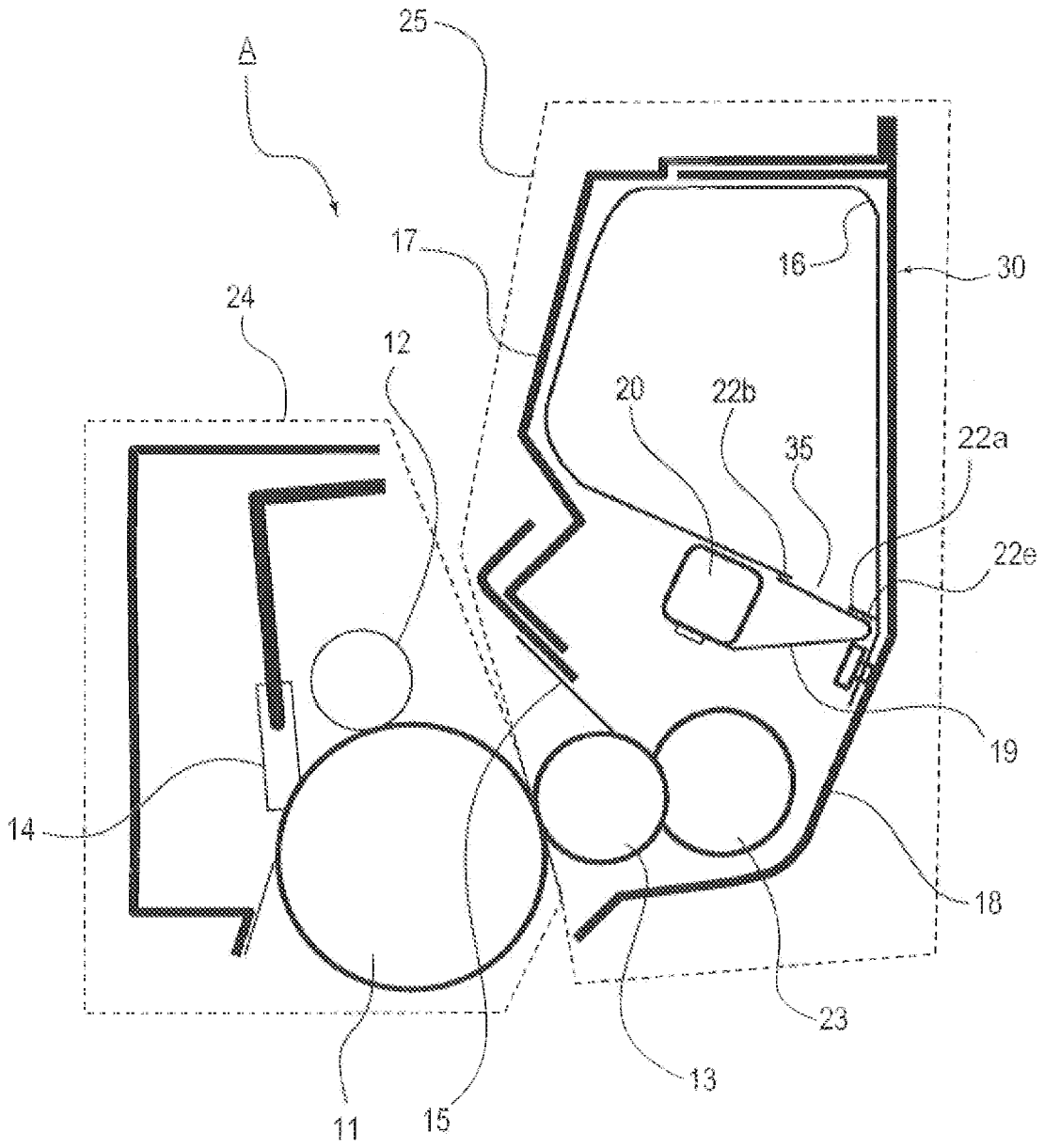
FIG. 1 is a sectional view of a cartridge.

FIG. 1 is a sectional view of a process cartridge A. The cartridge A includes the image bearing member and process means actable on the image bearing member. Examples of the process means may include, e.g., a charging means for electrically charging the surface of the image bearing member, a developing device for forming an image on the surface of the image-bearing member, and a cleaning means for removing a developer (containing a toner, a carrier and the like) remaining on the surface of the image bearing member.

Figure 2:
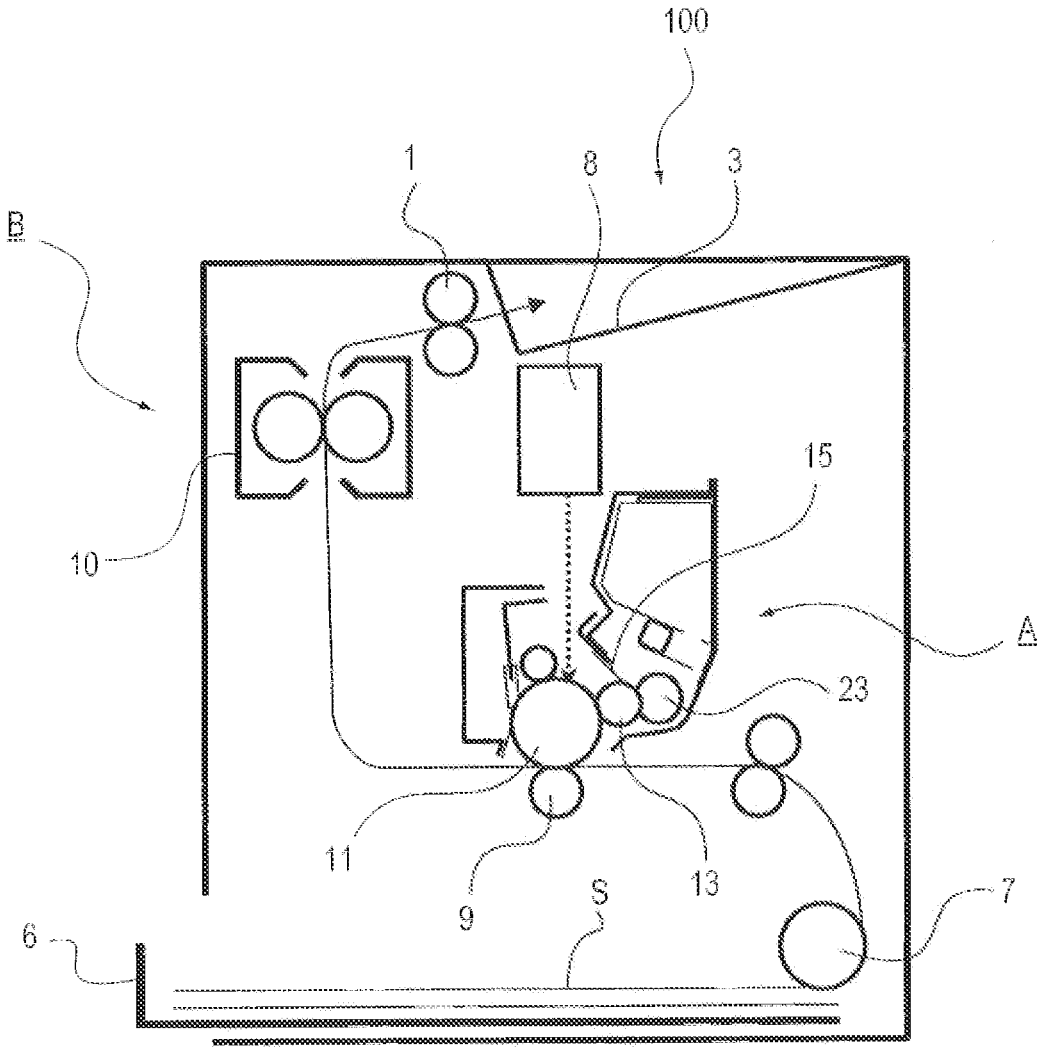
FIG. 2 is a sectional view of an image forming apparatus.

The cartridge A is prepared by integrally assembly a cleaner unit 24 and a developing accommodating unit 25 (developing device), and is configured to be detachably mount able to an image forming apparatus main assembly B shown in FIG. 2. The cleaner unit 24 includes a photosensitive drum 11 as an electrophotographic photosensitive drum which is the image bearing member, a charging roller 12 as the charging means, an elastic cleaning blade 14 as the cleaning means. The developing accommodating unit 25 includes a first frame 17 and a second frame 18. The developing accommodating unit 25 includes therein a developing roller 13 as a developing means, a developing blade 15, a (developer) supplying roller 23 and an accommodating container 30 in which the developer is accommodated. The developing roller 13 and the developing blade 15 are supported by the first frame 17.

FIG. 2 is a sectional view of an image forming apparatus 100 as an electrophotographic image forming apparatus. The cartridge A is mounted in the apparatus main assembly 8 and is used for image formation. A sheet S is fed by a feeding roller 7 from a sheet cassette 6 provided at a lower portion of the apparatus, and in synchronism with this feeding of the sheet, an exposure device 8 selectively exposes the photosensitive drum 11 to light, so that a latent image is formed on the photosensitive drum 11.

The developer is supplied to the developing roller 13 (developer carrying member) by a sponge-like supplying roller 23, and is carried in a thin layer on the surface of the developing roller 13 by the developing blade 15. By applying a developing bias to the developing roller 13, the developer is supplied depending on the latent image to develop the latent image into a developer image. This developer image is transferred onto the sheet S conveyed by application of a bias voltage to a transfer roller 9. The sheet S is conveyed into a fixing device 10 in which the image is fixed on the sheet S, and then is discharged by a discharging roller 1 onto a discharge portion 3 at an upper portion of the apparatus.

Figure 3:
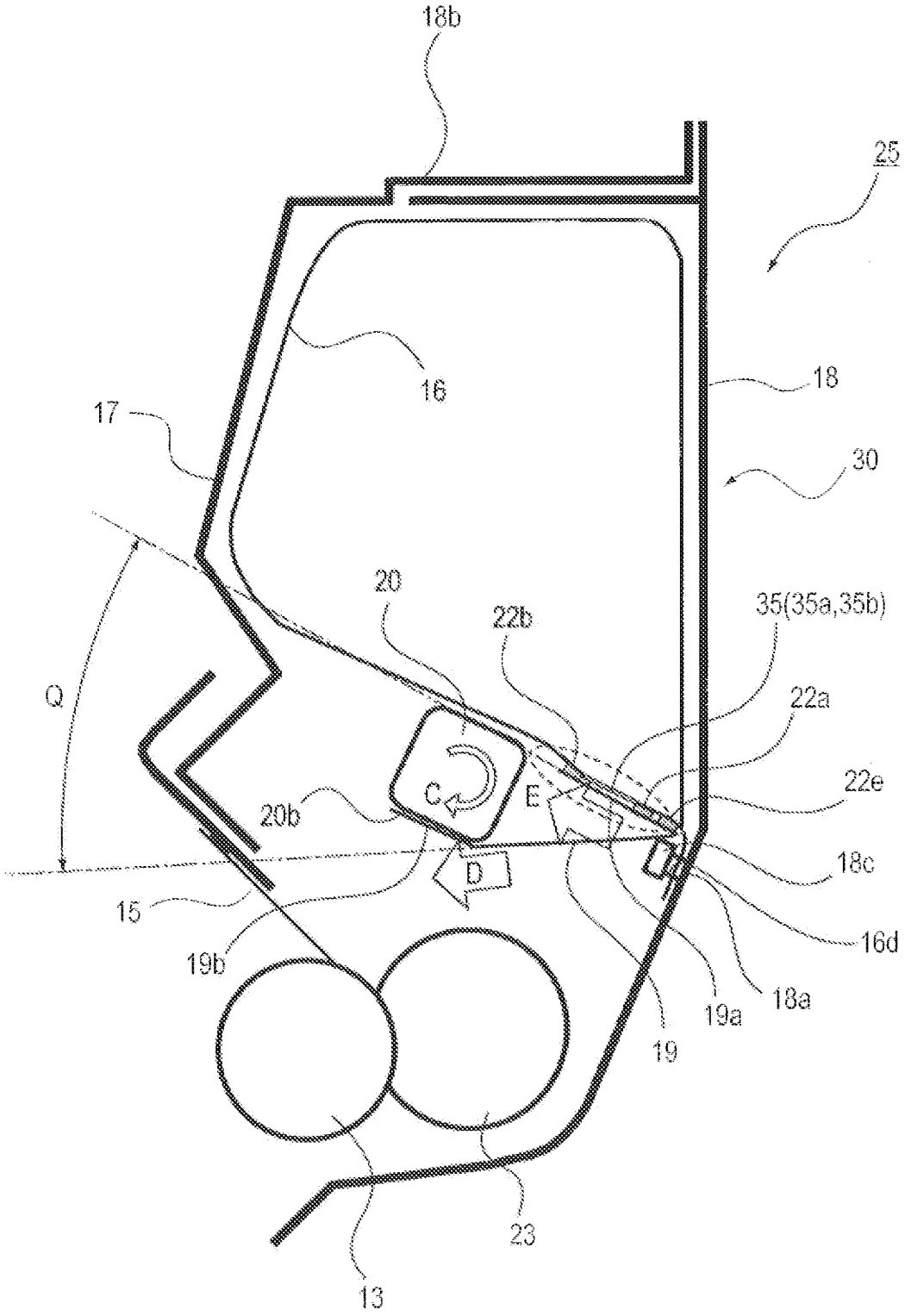
FIG. 3 is a sectional view of a developing device.

FIG. 3 is a sectional view of the developing accommodating unit 23. Parts (a) and (b) of FIG. 9 are partly enlarged sectional views of a developer bag 16. Incidentally, the sectional views show a flat plane passing through an unsealing member 20, openings 35*a* and a fixed portion 16*d* of the developer bag 16 fixed to a fixing portion 18*c* of the second frame 18, and is cut along a flat plane perpendicular to a rotation shaft (axis) of the unsealing member 20. The developing accommodating unit 25 includes the developing roller 13 and the developing blade 15.

Incidentally, in this embodiment, the developing accommodating unit 25 as the developing device has a constitution including the developing roller 13 and the developing blade 15, but may also nave a constitution from which the developer bag 16 is separated. However, in this case, such a relationship that the developing device includes the developing roller 13 and the developing blade 15, and the developing accommodating unit 25 includes the developer bag 16 is created.

Further, the developing accommodating unit 25 includes the accommodating container 30 in which the developer bag 16, a sealing member 19 and the unsealing member 20 are accommodated. The developer bag 16 as the flexible container includes openings 35*a* for permitting discharge of the developer. The sealing member 19 seals the openings 35*a* before the unsealing member 20 moves (rotates) and exposes the openings 35*a* when the unsealing member 20 moves (rotates). The unsealing member 20 is mounted on the sealing member 19, and when the unsealing member 20 moves (rotates), applies tension to the sealing member 19 to unseal the openings 35*a*. The accommodating container 30 supports inside members such as the developing roller 13, the developing blade, and the like, and includes the first frame 17 and the second frame 18.

As shown in FIG. 3, the developer bag is accommodating therein the developer is sealed by the sealing member 19 at the plurality of openings 35*a* (FIG. 4) for permitting discharge of the developer. The accommodating container 30 includes therein the developer bag 10 and the unsealing member 20. The unsealing member 20 includes a fixing portion 20*b* for fixing the sealing member 19.

On the other hand, the sealing member 19 includes a fixed portion 19*b*, fixed to the fixing portion 20*f* of the unsealing member 20, defined in a base end side thereof (in a downstream side thereof with respect to a peeling direction described later). In the accommodating container 30, the fixed portion 19*b* of the sealing member 19 is fixed to the fixing portion 20*b* of the unsealing member 20. The developer bag 16 accommodates the developer therein and has a deformable bag shape, and in order to permit discharge of the developer accommodated, therein, includes the plurality of openings 35*a* at a discharging portion 35.

Figure 4:
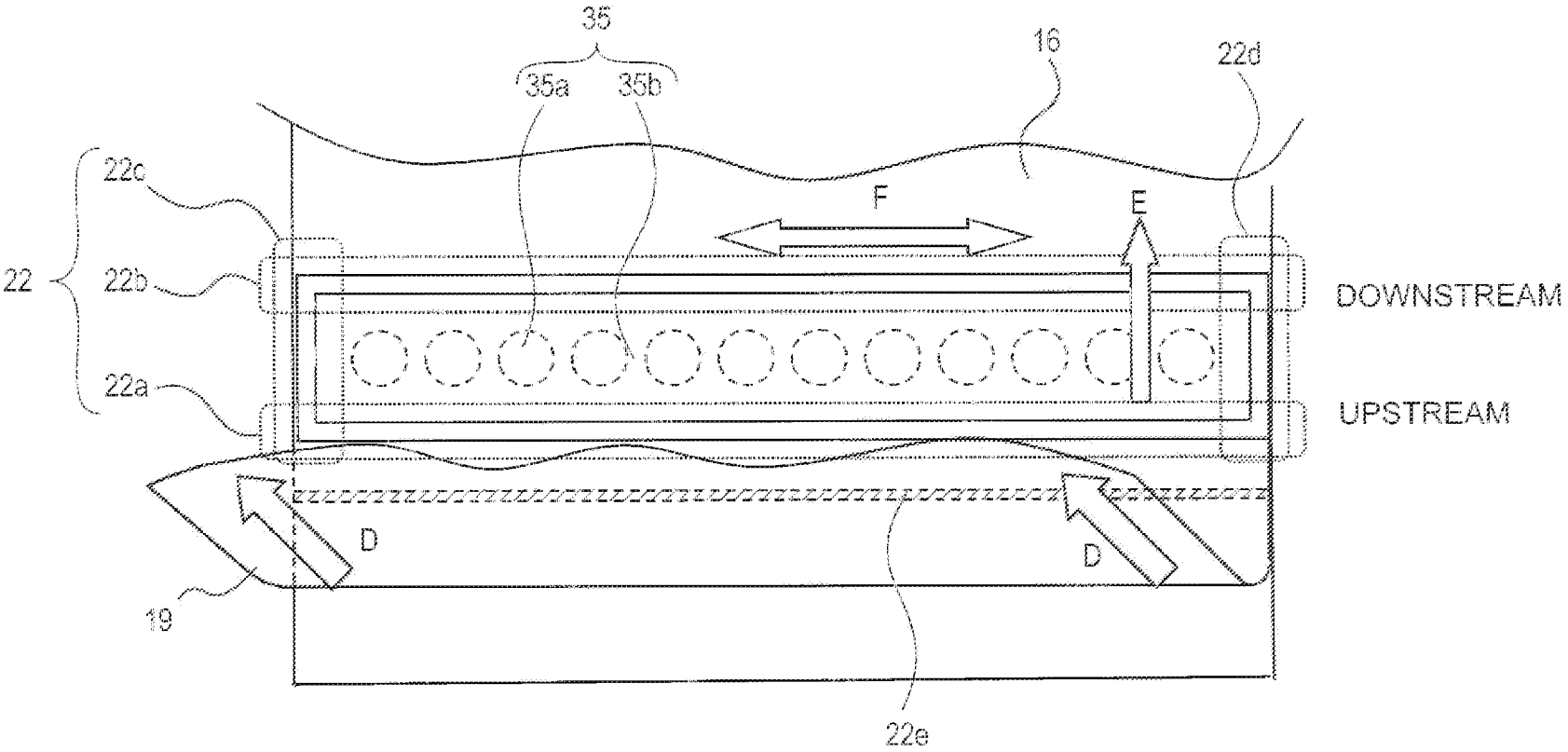
FIG. 4 is a plan view showing a structure of a discharging portion.

FIG. 4 is a plan view showing a structure of the discharging portion 35. As shown in FIG. 4, the developer bag 16 includes the discharging portion 35. The discharging portion 35 includes the plurality of openings 35*a* for permitting discharge of the developer inside the developer bag 16 and includes a connecting portion 35*b* for defining the plurality of openings 35*a*. The sealing member 19 covers the discharging portion 35, and a bonding portion 22 for bonding the developer bag 16 and the seating member 19 continuously surrounds an outer edge portion of the discharging portion 35, thus unsealably bonding the developer bag 16 and the sealing member 19. In this way, the sealing member 19 confines the developer accommodated in the developer bag 16.

As shown in FIGS. 3 and 4, the developing accommodating unit 25 includes, between the developer bag 16 and the sealing member 19, the bonding portion 22 for bonding the developer bag 16 and the sealing member 19. In other words, the sealing member 19 is bonded to the developer bag 16 by bonding portions (22*a*, 22*b*, 22*c*, 22*d* and 22*e*), defined in another end side thereof (in an upstream side with respect to the peeling direction described later), for bonding the developer bag 16 and the sealing member 19.

The bonding portion 22 includes a first bonding portion 22*a*, a second bonding portion 22*b*, a first widthwise bonding portion 22*c*, a second widthwise bending portion 22*d* and a third bonding portion 22*e*. At the bonding portion 22, two bonding portions welded with respect to a longitudinal direction (arrow F direction), i.e., the first bonding portion 22*a* and the second bonding portion 22*b*, and two bonding portions welded with respect to a widthwise direction (arrow E direction), i.e., the first widthwise bonding portion 22*c* and the second widthwise bonding portion 22*d* are provided. The bonding portions having a rectangular shape defined by these four bonding portions which surround the discharging portion 35 are continuous.

A structure of each of the bonding portions 22 (22*a* to 22*e*) will be specifically described below. The first bonding portion 22*a* extends in the longitudinal direction (axial direction of the unsealing member 20) in a peeling direction upstream side of the sealing member 19 (in an upstream side of the arrow E direction) at a periphery of the openings 35*a*. That is, the first bonding portion 22*a* is disposed at a position upstream of the openings 35*a* with respect to the arrow E direction, and extends in the arrow F direction. The second bonding portion 22*b* extends in the longitudinal direction (axial direction of the unsealing member 20) in a peeling direction downstream side of the sealing member 19 (in a downstream side of the arrow E direction) at a periphery of the openings 35*a*. That is, the second bonding portion 22*b* is disposed at a position upstream of the openings 35*a* with respect to the arrow E direction, and extends in the arrow F direction.

Further, each at the first and second widthwise bonding portions 22*c* and 22*d* connects an end portion of the first bonding portion 22*a* and an end portion of the second bonding portion 22*b* at a periphery of the openings 35*a* or connects another end portion of the first bonding portion 22*a* and another end portion of the second bonding portion 22*b* at a periphery of the openings 35*a*, and extends in the widthwise direction (arrow E direction). That is, the first widthwise bonding portion 22*c* is disposed at a position where it is closer to the above-described "one end portions" (of the first and second bonding portions 22*a* and 22*b*) than the openings 35*a* with respect to the arrow F direction, and extends in the arrow E direction. Further, the second widthwise bonding portion 22*d* is disposed at a position where it is closer to the above-described "another end portions" (of the first and second bonding portions 22*a* and 22*b*) than the openings 35*a* with respect to the arrow F direction, and extends in the arrow E direction.

The first bonding portion 22*a*, the second bonding portion 22*b*, the first widthwise bonding portion 22*c* and the second widthwise bonding portion 22*d* which are described above form a closed region in which the discharging portion 35 is sealed, thus sealing the discharging portion 35.

Further, the third bonding portion 22*e* bonds the developer bag 16 and the sealing member 19 in a side upstream of the first bonding portion 22*a* with respect to the peeling direction of the sealing member 19. That is, the third bonding portion 22*e* is disposed at a position upstream of the first bonding portion 22*a* with respect to the arrow E direction, and extends in the arrow F direction. The third bonding portion 22*e* continuously extends in a rectilinear line shape in the arrow F direction.

Figure 5:
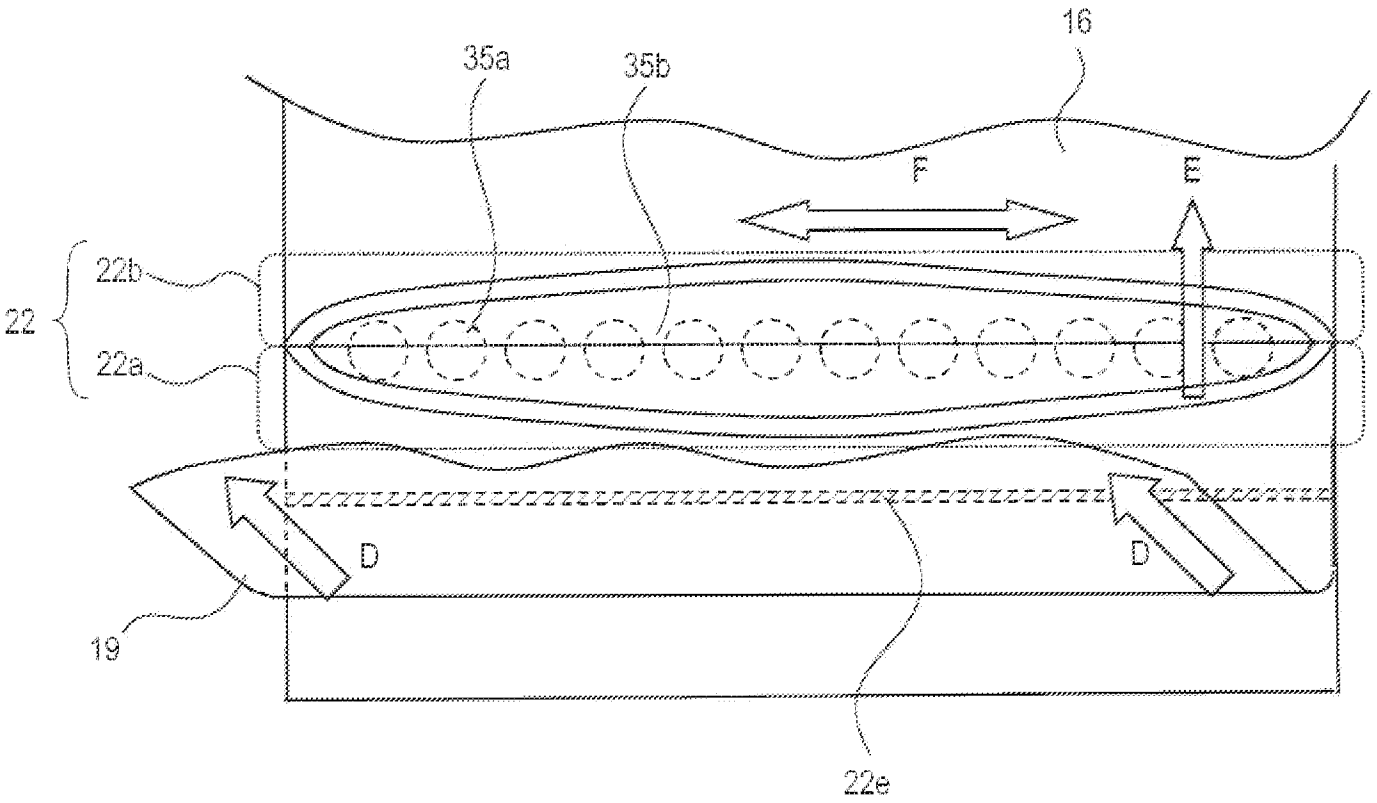
FIG. 5 is a plan view showing a modified example of the discharging portion.

FIG. 5 is a plan view showing a modified example in this embodiment. As shown in FIG. 5, at a part of the bonding portion 22, the bonding portion 22 may also be continuous by two bonding portions welded with respect to the longitudinal direction (arrow F direction), i.e., by only two curved lines consisting of a first bonding portion 22*a* and a second bonding portion 22*b* so as to surround the discharging portion 35.

Specifically, the first bonding portion 22*a* is formed so as to be flexed (curved) toward an upstream side of the peeling direction, and the second bonding portion 22*b* is formed so as to be flexed (curved) toward a downstream side of the peel direction. Further, end portions of the first bonding portion 22*a* and end portions of the second bonding portion 22*b* are disposed adjacently to each other. Also in this case, a part of the bonding portion 22 forms a closed region for sealing the discharging portion 35 and is capable of sealing the discharging portion 35. However, in this case, the bonding portion 22 is constituted by only the first bonding portion 22*a*, the second bonding portion 22*b* and the third bonding portion 22*e*, and positions of other constituent elements are the same as those described above.

Figure 6:
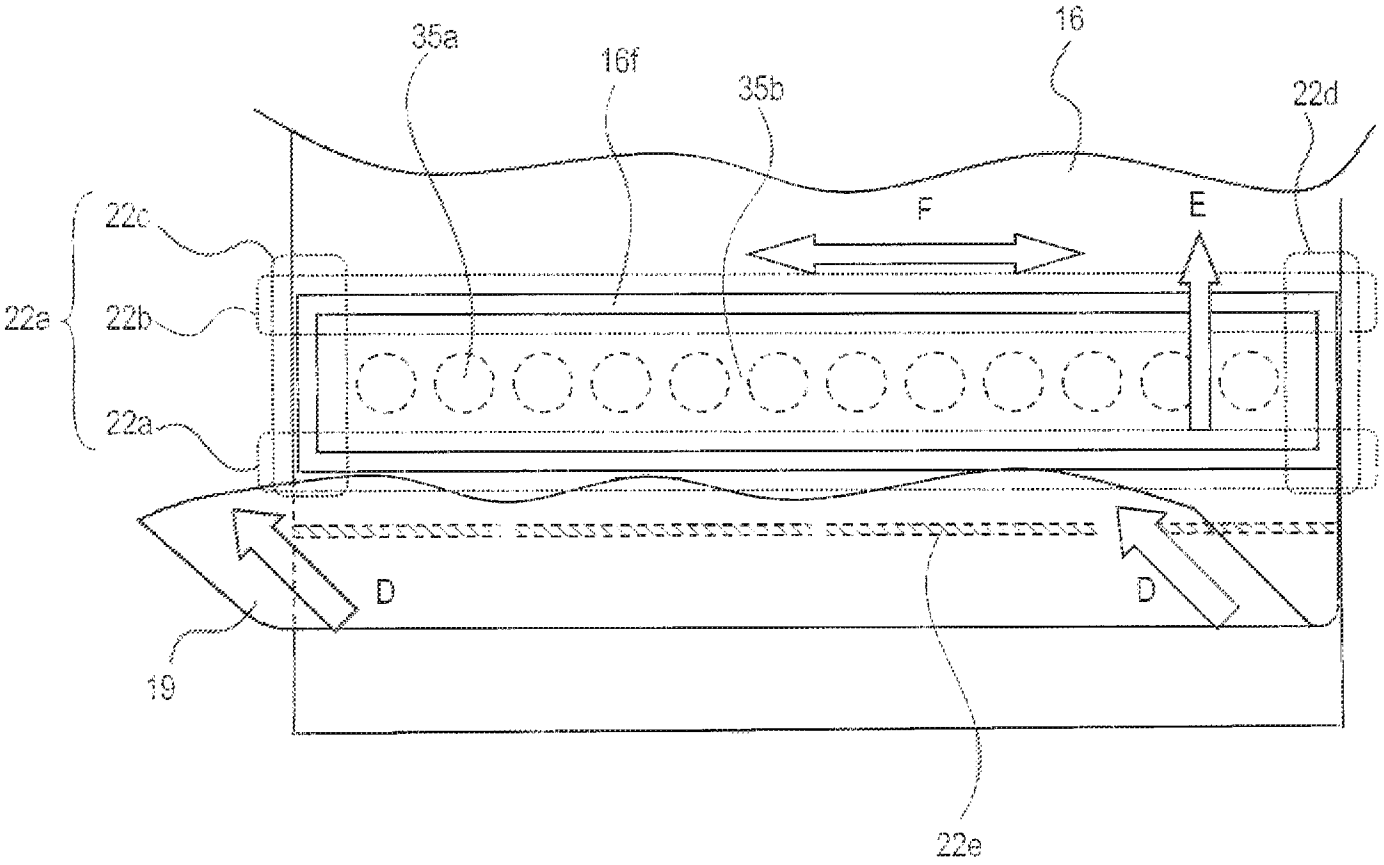
FIGS. 6 and 7 are plan views each showing a modified example of a third bonding portion.
Figure 7:
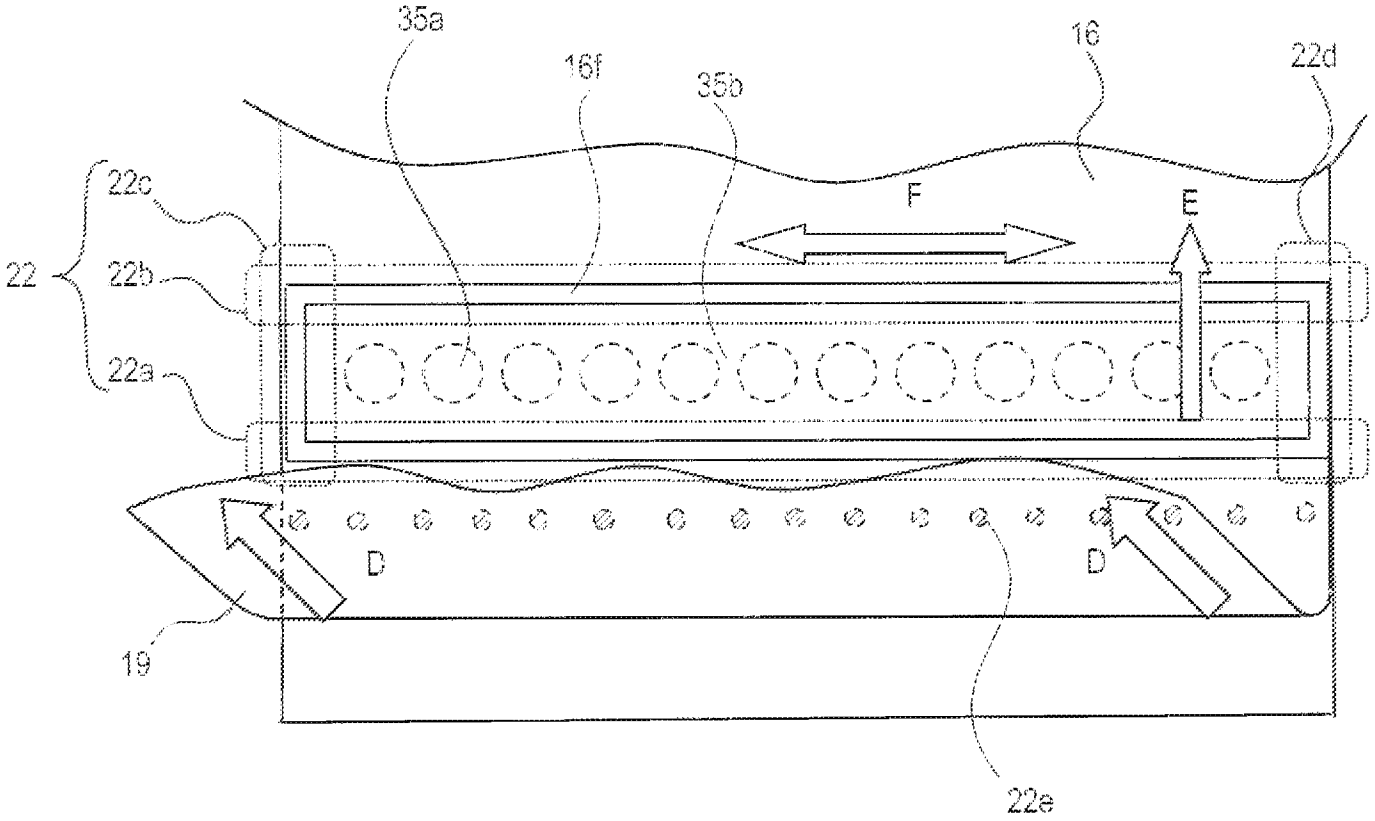

FIGS. 6 and 7 are plan views each showing a modified example of the third bonding portion 22*e*. In FIG. 6, the third bonding portion 22*e* is welded so as to be extended in a rectilinear line shape while being intermittently disposed (while being spaced at predetermined intervals) with respect to the arrow F direction, so that all of portions constituting the third bonding portion 22*e* are not always continuously welded. In FIG. 7, with respect to the arrow F direction, small circled portions are welded so as to be arranged in a rectilinear line shape at predetermined intervals. Incidentally, the third bonding portion 22*e* may also be bonded in a manner such that the third bonding portion 22*e* of FIG. 6 and the third bonding portion 22*e* of FIG. 7 are mixed (not shown).

Here, of the first bonding portion 22*a*, the second bonding portion 22*b* and the third bonding portion 22*e*, a portion peeled first is the third bonding portion 22*e*, and the portion peeled secondly is the first bonding portion 22*a*, and then a portion peeled finally is the second bonding portion 22*b*. As a result, when the sealing member 19 exposes the openings 35*a*, the bonding portion 22 is peeled in the order of the third bonding portion 22*e*, the first bonding portion 22*a* and the second bonding portion 22*b*.

In this embodiment, as shown in FIGS. 3 and 4, the peeling direction is the arrow E direction. An unsealing direction is defined as follows. In the case where the peeling is performed by moving the sealing member 19, of the first bonding portion 22*a* and the second bonding portion 22*b* between which the openings 35*a* are interposed, the first bonding portion 22*a* is peeled earlier. In this way, a direction directed from the first bonding portion 22*a* peeled earlier toward the second bonding portion 22*b* is defined as the unsealing direction, i.e., the arrow E direction.

Incidentally, when the sealing member 19 is unsealed (peeled) from the developer bag 16 in the arrow E direction, in some cases, the peeling microscopically advances, also in the third bonding portion 22*b*, the first bonding portion 22*a* and the second bonding portion 22*b*, also in the arrow F direction due to deformation of the developer bag 16 caused by an unsealing force. However, the unsealing direction in this embodiment does not refer to such a microscopically unsealing direction.

Next, a structure and a state of the openings 35*a* will be described with reference FIGS. 3, 9, 4 and 8. Particularly, of these figures, the figure in which all of the directions of the arrows D, E and F are indicated is FIG. 4 and therefore it is easy to understand the structure and state of the openings 35*a* when reference to FIG. 4 is made. Here, the arrow D direction (movement direction) is a movement direction of the sealing member 19 (a direction in which the sealing member 19 is pulled by the unsealing member 20). Before the sealing member 19 is pulled, the sealing member 19 seals the openings 35*a*, but when the sealing member 19 is pulled, the sealing member 19 exposes the 19 openings 35*a*.

The arrow E direction (unsealing direction) is a direction in which the scaling member 19 is peeled from the discharging portion 35 to unseal the openings 35*a*. The arrow F direction is a direction perpendicular to the arrow E direction which is the unsealing direction, and is the same direction as an axis of the rotation shaft of the unsealing member 20, and also is a direction in which the plurality of openings 35*a* and the plurality of connecting portions 35*b* are alternately arranged.

Each of the plurality of openings 35*a* has a circular shape. When a discharging property is taken into consideration, an area of the openings 35*a* may preferably be large. Further, the connecting portions 35*b* defining the openings 35*a* may preferably be large (thick) in order to enhance strength of the developer bag 16. Therefore, the area of the openings 35*a* and the area of the connecting portions 35*b* are required to be balanced depending on a material and thickness of the discharging portion 35 and a force relationship with peeling strength during unsealing described later, and the like, and may be appropriately selected. Further, the shape of the openings 35*a* may also be shapes, other than the circular shape, such as a polygonal shape including a rectangular shape or the like, and an elongated circular shape (not shown).

Further, a direction normal to a plane or formation of the openings 35*a* may preferably be set so as to permit easy discharge of the developer accommodated in an attitude during image formation. For that reason, in the attitude during the image formation, the openings 35*a* are disposed to open downward with respect to the direction of gravitation. Here, "open downward with respect to the direction of gravitation" refers to that the direction in which the openings 35*a* open has a downward component with respect to the vertical direction.

Figure 8:
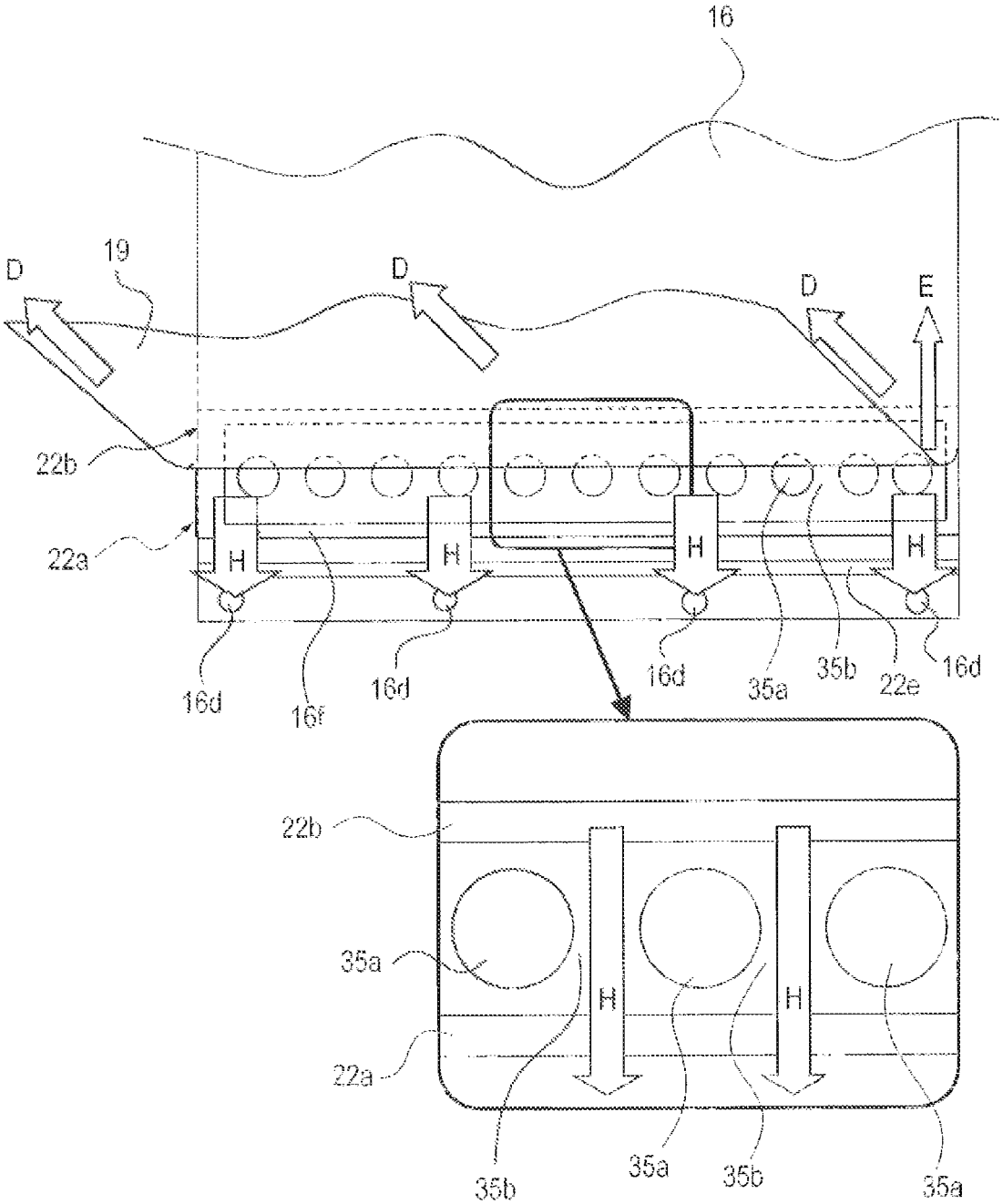
FIG. 8 is a plan view showing the discharging portion and openings.

As shown in FIG. 3, the fixed portion 16*d* of the developer bag 16 is fixed to the fixing portion 18*a* of the second frame 18. The fixed portion 16*d* of the developer bag 16 receives a force when the sealing member 19 is unsealed from the developer bag 16. In parallel to the arrow F direction (FIG. 4) in which the plurality of openings 35*a* are disposed, a plurality of fixed portions 16*d* of the developer bag 16 are provided (FIG. 8). Incidentally, other than the case where the plurality of fixed portions 16*d* of the developer bag 16 are provided as described above, an elongated single fixed portion 16*d* in parallel to the arrow F direction may also be provided (not shown). Further, the fixed portion 16*d* is positioned in the neighborhood of the openings 35*a*. The fixed portion 16*d* is a fixed portion necessary during unsealing of the developer bag 16, and action and arrangement of the fixed portion 16*d* will be described later in explanation of the unsealing.

As shown in FIG. 3, the sealing member 19 covers, before use of the cartridge A, the discharging portion 35 of the developer bag 16, thus confining the developer in the developer bag 16 as described above. The sealing member 19 includes a sealing portion 19*a* for covering the discharging portion 35 of the developer bag 16 and a fixed portion 19*b*, and is formed in a sheet-like shape. The sheet is formed of a laminate material having a sealant layer, described later, which exhibits an easy-unsealing property, and as a base material for the sheet, polyethylene terephthalate (PET), polyethylene, polypropylene and the like may be used, and may appropriately be formed in a thickness of 0.03-0.15 mm. Further, as described later, the bonding portion 22 is formed by an effect of both of the sealant layer of the sealing member 19 and the material for the developer bag 16. The sealing portion 19*a* is a region of the sealing member 19 in a leading end side of the sealing member 19, and is a portion of a region in which the discharging portion 35 is sealed. The sealing portion 19*a* includes the plurality of the openings 35 and the connecting portions 35*b*. By the sealing portion 19*a*, until the cartridge A is used, the developer is prevented from being leaked from the inside of the developer bag 16.

The fixed portion 19*b* is a portion of a region which is located in a base end side of the sealing member 19 and in which the sealing member 19 is mounted on the unsealing member 20. When the unsealing member 20 is rotated, the fixed portion 19*b* is pulled, so that the sealing member 19 exposes the openings 35*a*. The unsealing member 20 may also be configured to automatically unseal the openings 35*a* by receiving a driving force from the apparatus main assembly B. Or, the unsealing member 20 may also be configured to unseal the openings 35*a* by causing the user to grip and move the unsealing member 20. The unsealing member 20 is the rotation shaft provided in the frame, and the sealing member 19 fixed on the unsealing member 20 is pulled, whereby the developer bag 16 in which the developer is accommodated is unsealed.

Next, a method of setting a peeling force of the bonding portion 22 at a desired value will be described. In order to set the peeling force of the bonding portion 22 at the desired value (a minimum force for unsealing (peeling) the bonding portion 22 within a range in which the toner sealing property can be maintained), two methods are principally employed.

In a first method, the laminate material having the sealant layer is used for the sealing member 19 so as to permit easy unsealing. Further, as the material for the developer bag 16, a sheet material (of, e.g., polyethylene or polypropylene) which is weldable with the sealant layer and which has flexibility is used. The bonding portion 22 is formed by, e.g., welding both of the sealant layer or the sealing member 19 and the sheet material of the developer bag 16, and by an effect of the both members (materials), the bonding portion 22 can be easily unsealed. By changing a combination of formulation of the sealant layer with the material to be bonded, the peeling force can be adjusted correspondingly to a desired condition. In this embodiment, the sealing member 19 having peeling strength of about 3N/15 mm in testing methods for heat sealed flexible packages according to JIS-Z0238 is used.

A second method is a method in which as shown in FIGS. 3 and 7, the discharging portion 35 of the developer bag 16 is placed in a state in which the sealing member 19 is folded back with respect to a direction (arrow E direction) in which the unsealing advances. For example, in the state of FIG. 3, the unsealing member 20 is rotated in an arrow C direction, so that the sealing member 19 is pulled in an arrow D direction by the unsealing member 20. As a result, the developer bag 16 and the sealing member 19 establish an inclination peeling positional relationship, as shown in FIG. 3, as a narrow angle Q, which is 90 degrees or less between the surface of the bonding portion 22 of the developer bag 16 and the surface of the sealing member 19 along the arrow D direction in which the sealing member 19 is to be pulled.

It has been conventionally known that the peeling force necessary to separate both members can be reduced by establishing the inclination peeling positional relationship. Therefore, as described above, the sealing member 19 is placed in the state in which the sealing member 19 is folded back with respect to the arrow E direction in which the unsealing advances, so that the sealing member 19 and the developer bag 16 establish the inclination peeling positional relationship at the bonding portion 22 and thus the peeling force can be adjusted so as to be reduced.

The unsealing member 20 is used for the purpose of peeling the sealing member 19 from the developer bag 16 by applying the force to the sealing member 19. The unsealing member 20 includes a shaft-shaped supporting portion (not shown) rotatably supported at its ends by the second frame 18 and includes the fixing portion 20*b* for fixing the fixed portion 19*b* of the sealing member 19. In this embodiment, the unsealing member 20 has a rectangular shaft shape, and on one surface of the rectangular shaft, the fixed portion 19*b* of the sealing member 19 is fixed by the rising portion 20*b*.

Next, the unsealing of the developer bag 16 will be described with reference to FIGS. 3, 4, and 8-11. In each time series with respect to the order of the unsealing, each of a group of FIGS. 3, 4, and 9(*a*), and a group of FIGS. 8 and 10(*a*) shows a state at the same time.

First, as shown in FIG. 3 and (a) of FIG. 9, the unsealing member 20 is rotated in the arrow C direction by transmitting a driving force from an unshown main assembly to the unsealing member 20. Then, rotation of the unsealing member 20 advances, and the sealing member 19 is pulled, so that a force is first exerted on the third bonding portion 22*e* to peel the third bonding portion 22*e* ((b) of FIG. 9).

Further, the rotation of the unsealing member 20 advances, so that the force is exerted on the first bonding portion 22*a* ((a) of FIG. 10). Then, the rotation of the unsealing member 20 further advances, so that the first bonding portion 22*a* is peeled to start the unsealing of the discharging portion 35, thus exposing the openings 35*a* ((b) of FIG. 10).

Then, the rotation of the unsealing member 20 advances, so that the force is exerted on the second bonding portion 22*b* ((a) of FIG. 11). Subsequently, when the rotation of the unsealing member 20 further advances, the second bonding portion 22*b* is finally peeled and thus the unsealing is completed ((b) of FIG. 11). The developer inside the developer bag 16 is discharged through the openings 35*a* in an arrow I direction.

In the following, an effect of the third bonding portion 22*e* will be described. First of all, as a comparison example, in the case where there is no constitution including the third bonding portion 22*e*, a phenomenon which can occur in some rare cases in a manufacturing process (step) will be described.

Next, the effect of the third bonding portion 22*e* in the constitution in this embodiment of the present invention in which a possibility of the occurrence of the phenomenon is reduced will be described.

First, the phenomenon which can occur in some rare cases in the case where there is no constitution including the third bonding portion 22*e* will be described with reference to FIGS. 12 and 13. FIG. 12 shows a developer bag 16 which has the constitution in which there is no third bonding portion 22*e* and which accommodates the developer but does not include the unsealing member 20 for unsealing the sealing member 19. On the other hand, FIG. 13 is a sectional view of a cartridge A which has the constitution in which there is no third bonding portion 22*e* and which includes the developing accommodating unit 25.

In a state shown in FIG. 12, i.e., a state in which the sealing member 19 seals the openings 35*a* of the developer bag 16 in which the developer is accommodated, the following action can occur depending on handling. When an unexpected force with respect to an arrow X direction acts on the first bonding portion 22*a*, depending on a magnitude of the force, there is a possibility that at least a part of the first bonding portion 22*a* is peeled.

When at least the part of the bonding portion 22 is peeled, a performance (power) for unsealing (confining) the developer by the bonding portion 22 is weaker than an intended performance. Then, in a process until the cartridge A is delivered to the user and thereafter the user mounts the cartridge A in the image forming apparatus, by the reason of a load or the like during transportation, the peeling of the bonding portion advances to the extent that the developer is leaked out from the developer bag 16, so that erroneous unsealing can occur. At worst, as shown in FIG. 13, there is a possibility that the developer is leaked out from the cartridge A and then a user's hand is contaminated with the developer. Next, the embodiment of the present invention in which the possibility of the occurrence of the phenomenon as described above is reduced will be described.

FIG. 14 shows a developer bag 16 which accommodates the developer and which does not include the unsealing member 20 for unsealing the sealing member 19. In this embodiment, in a state shown in FIG. 14, i.e., in a state in which the sealing member 19 seals the openings 35*a* of the developer bag 16 in which the developer is accommodated, when handling is effected, e.g., in the case where the unexpected force directed in the arrow X direction is exerted, the following phenomenon occurs. That is, the force is directly exerted on the third bonding portion 22*e*, not the first bonding portion 22*a*. For this reason, even when at least a part of the bonding portion is peeled, the peeling is generated first at the third bonding portion 22*e* rather than the first bending portion 22*a*, so that the possibility of the peeling of at least a part of the first bonding portion 22*a* is lower in this embodiment than in the above-described comparison example.

Embodiment 2

FIG. 15 is a sectional view showing a developer bag 16 in this embodiment. In this embodiment, constitutions and effects of inside members of a cartridge A which are not particularly mentioned are the same as those in Embodiment 1 and therefore will be omitted from description.

In this embodiment, the developer bag 16 includes a container-forming bonding portion 41 for forming a closed space container by bonding inner surfaces to each other. In a direction (arrow E direction) normal to a plane of a portion of the developer bag 16, where the container forming bonding portion 41 is bonded to the developer bag 16, the container forming bonding portion 41 and the third bonding portion 22*e* at least partly overlap with each other. Incidentally, the container forming bonding portion 41 and the third bonding portion 22*e* may completely overlap with each other (FIG. 16).

According to the constitutions in Embodiments 1 and 2, in the constitution in which the openings 35*a* of the developer bag 16 in which the developer is accommodated is sealed by the sealing member 19, it is possible to reduce the phenomenon, that the unexpected force is exerted on the bonding portions 22*a* and 22*b* for bonding the openings 35*a* and the sealing member 19 at the periphery of the openings 35*a* to peel the sealing member 19. In the process until the cartridge A is delivered to the user and then the user mounts the cartridge A in the apparatus main assembly B, when the sealing member 19 is erroneously unsealed due to a load or the like during transportation, it is possible to alleviate a degree of three disadvantages of leakage of the developer from the developer bag 16, leakage of the developer from the cartridge A, and contamination of the user's hand with the developer.

According to the present invention, in the constitution in which the openings of the flexible container in which the developer is accommodated is sealed by the sealing member, it is possible to reduce the phenomenon that the unexpected force is exerted on the bending portion for bonding the openings and the sealing member at the periphery of the openings to peel the sealing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 199741/2012 filed Sep. 11, 2012, which is hereby incorporated by reference.

What is claimed is:

1. A developer accommodating unit comprising:

a flexible container including an opening for permitting discharge of a developer;

a sealing member having a bonding portion to seal the opening; and an unsealing member, attached to said sealing member, for unsealing said sealing member, wherein said bonding portion includes (i) a first bonding portion extending lengthwise in a direction crossing a peeling direction, (ii) a second bonding portion provided in a downstream side of said first bonding portion with respect to the peeling direction, and (iii) a third bonding portion bonded upstream of said first bonding portion with respect to the peeling direction, wherein, when said sealing member exposes the opening, said bonding portion is peeled in the order of said third bonding portion, said first bonding portion, and said second bonding portion, and wherein, when said sealing member exposes said opening, the flexible container is deformed to change a shape of said opening.

2. A developer accommodating unit according to claim 1, wherein said first bonding portion extends in a longitudinal direction of said unsealing member.

3. A developer accommodating unit according to claim 1, wherein said second bonding portion extends in a longitudinal direction of said unsealing member.

4. A developer accommodating unit according to claim 1, wherein said third bonding portion extends in a longitudinal direction of said unsealing member in an upstream side of said first bonding portion.

5. A developer accommodating unit according to claim 1, wherein said third bonding portion extends intermittently in a longitudinal direction of said unsealing member in an upstream side of said first bonding portion.

6. A developing device comprising:

a developer accommodating unit according to claim 1; and a developer carrying member for carrying the developer.

7. A developer accommodating unit according to claim 1, further comprising a frame for accommodating said flexible container.

8. A developer accommodating unit according to claim 1, further comprising a frame for accommodating said flexible container, said sealing member, and said unsealing member.

9. A developer accommodating unit according to claim 1, wherein said first bonding portion is positioned at a periphery of the opening.

10. A developer accommodating unit according to claim 1, wherein said second bonding portion is positioned at a periphery of the opening.

11. A developer accommodating unit according to claim 1, wherein said flexible container includes a container forming bonding portion bonded so as to form a container having a closed space therein, and wherein said third bonding portion and said container forming bonding portion overlap with each other with respect to a direction normal to a plane of said flexible container at a position where said container forming bonding portion is bonded to said flexible container.

12. A process cartridge detachably mountable to a main assembly of an image forming apparatus, said process cartridge comprising:

an electrophotographic photosensitive drum; and a developer accommodating unit according to claim 1 integrally assembled with said electrophotographic photosensitive drum.

13. An electrophotographic image forming apparatus comprising a process cartridge according to claim 12.

14. A developer accommodating unit according to claim 1, wherein the opening remains sealed to prevent discharge of the developer through the opening after said third bonding portion is peeled.

15. A developer accommodating unit according to claim 1, wherein, when said developing unit is oriented such that said second bonding portion is highest in the direction of gravity, said first bonding portion is positioned above said third bonding portion, and said second bonding portion is positioned above said first bonding portion.

16. A developing accommodating unit according to claim 1, wherein said second bonding portion is a shorter distance from said unsealing member than said first bonding portion is distanced from said unsealing member, and said first bonding portion is a shorter distance from said unsealing member is than said third bonding portion is distanced from said unsealing member.

17. A developer accommodating unit according to claim 1, wherein the opening is arranged between the first bonding portion and second bonding portion.

18. A developer accommodating unit according to claim 1, wherein a lengthwise direction of the opening crosses the peeling direction.

19. A developer accommodating unit according to claim 1, wherein an axis of unsealing member is parallel to the lengthwise direction of said first bonding portion and parallel to the lengthwise direction of said second bonding portion.

20. A developer accommodating unit comprising:

a flexible container including an opening for permitting discharge of a developer;

a sealing member having a bonding portion to seal the opening; and an unsealing member, attached to said sealing member, for unsealing said sealing member, wherein said bonding portion includes (i) a first bonding portion extending lengthwise in a direction crossing a peeling direction, (ii) a second bonding portion provided in a downstream side of said first bonding portion with respect to the peeling direction, and (iii) a third bonding portion bonded upstream of said first bonding portion with respect to the peeling direction, wherein, when said sealing member exposes the opening, said bonding portion is peeled in the order of said third bonding portion, said first bonding portion, and said second bonding portion, and wherein the third bonding portion extends intermittently in a longitudinal direction of said unsealing member in an upstream side of said first bonding portion.

* * * * *